US005924579A

United States Patent [19]

DuPont et al.

[11] Patent Number: 5,924,579

[45] Date of Patent: Jul. 20, 1999

[54] BARBER SHOP RACK FOR ELECTRIC HAIR CLIPPERS

[76] Inventors: Jeffrey K. DuPont, 11007 Dekalb Pl., Charlotte, N.C. 28262; Daniel Frederick Mason, 240 Wellingford St., Charlotte, N.C. 28213

[21] Appl. No.: 09/023,524

[22] Filed: Feb. 13, 1998

[51] Int. Cl.[6] ..... A47F 5/08

[52] U.S. Cl. ..... 211/70.6; 211/60.1; 211/106; D6/526; 30/541

[58] Field of Search ..... 211/70.6, 106, 211/26, 60.1, 119.003, 90.03, 119, 106.01, 41.4; 174/48; D6/526; 30/541

[56] References Cited

U.S. PATENT DOCUMENTS

| | | | |
|---|---|---|---|
| 591,078 | 10/1897 | Jewell | 211/106.01 X |
| 1,540,959 | 6/1925 | Schumacker | 211/70.6 X |
| 1,614,011 | 1/1927 | Martins . | |
| 1,918,027 | 7/1933 | Fullmer . | |
| 2,099,906 | 11/1937 | Reese et al. . | |
| 2,221,659 | 11/1940 | Wilkie | 211/119 |
| 2,294,204 | 8/1942 | Ploner et al. . | |
| 2,411,196 | 11/1946 | Dolan, II . | |
| 2,471,825 | 5/1949 | Long . | |
| 2,506,897 | 5/1950 | Sheker | 211/119 X |
| 2,805,908 | 9/1957 | Ankovitz . | |
| 2,974,671 | 3/1961 | Lewis . | |
| 3,128,022 | 4/1964 | Mastrud, Jr. . | |
| 3,184,202 | 5/1965 | Thiefoldt et al. . | |
| 3,240,324 | 3/1966 | Braun . | |
| 3,397,795 | 8/1968 | Elting | 211/119 X |
| 3,814,263 | 6/1974 | Kinard | 211/106 |
| 3,854,588 | 12/1974 | Kinard | 211/106 |
| 4,159,773 | 7/1979 | Losenno . | |
| 4,232,785 | 11/1980 | Lucas . | |
| 4,412,618 | 11/1983 | La Conte . | |
| 4,672,703 | 6/1987 | Frazier . | |
| 4,830,198 | 5/1989 | Colquitt . | |
| 4,871,074 | 10/1989 | Bryson et al. . | |
| 4,898,281 | 2/1990 | Cherry . | |
| 4,966,278 | 10/1990 | Rosi et al. . | |
| 5,031,778 | 7/1991 | Edgecombe . | |
| 5,046,625 | 9/1991 | Rushing . | |
| 5,169,102 | 12/1992 | Bracken . | |
| 5,316,155 | 5/1994 | Collins et al. | 211/106.01 X |
| 5,379,903 | 1/1995 | Smith . | |
| 5,386,915 | 2/1995 | Sirhan . | |

*Primary Examiner*—Daniel P. Stodola
*Assistant Examiner*—Khoa Tran
*Attorney, Agent, or Firm*—Kennedy Covington Lobdell & Hickman, LLP

[57] ABSTRACT

A rack for receiving and retaining a plurality of electric hair clippers in a ready-to-use position for use by a barber includes a mounting frame and a plurality of electric hair clipper holding structures attached thereto, each structure including: a base support bar for supporting a bottom of an electric hair clipper and a back support bar for supporting an upper back portion of the hair clipper, the base support bar and the back support bar cooperating to receive and retain the hair clipper in a ready-to-use disposition; two side retaining arms respectively extending from opposite ends of the back support bar generally orthogonal to the back support bar and in proximity to the sides of the hair clipper, thereby preventing the hair clipper from sliding out the structure while in resting engagement with the back support bar; two base retaining arms respectively extending from opposite ends of the base support bar generally orthogonally to the base support bar and in proximity to the lower front of the hair clipper, thereby preventing the hair clipper from sliding frontwardly out of the structure while in resting engagement with the base support bar; and a connecting bar extending between and connecting together the base support bar and the back support bar. Each structure is designed to receive and retain a particular size electric hair clipper independent of other structures whereby a plurality of various types and sizes of hair clippers are presented to a barber in a reclined position ready for use.

20 Claims, 3 Drawing Sheets

BARBER SHOP RACK FOR ELECTRIC HAIR CLIPPERS

FIELD OF THE PRESENT INVENTION

The present invention relates to a rack for receiving and retaining electric hair clippers ordinarily used in barber shops and, in particular, to a rack for receiving and retaining a plurality of electric hair clippers in a readily accessible position by a barber for intermittent use during hair cutting.

BACKGROUND OF THE PRESENT INVENTION

Barbers typically use two or more sizes of electric hair clippers during hair cutting and, when an electric hair clipper is not being used, the hair clipper is typically laid on a counter adjacent the barber's chair. Because of the proximity of the counter to the barber's chair and the attendant movement of the barber about the chair during hair cutting, the barber may inadvertently snag the electric cord of the hair clipper which often partially hangs off the counter thereby pulling the hair clipper off of the counter to drop down onto the floor. Additionally, a barber may not properly place the hair clipper onto the counter during hair cutting, whereby the hair clipper may fall or slide off of the counter being pulled by the weight of its electric cord hanging off the counter. The hair cutting teeth of the hair clipper are somewhat fragile and can easily be broken in a resultant fall and, to the detriment of the barber, such a damaged hair clipper is extremely expensive to repair or replace.

A conventional solution for safeguarding against the accidental dropping of electric hair clippers which has found wide spread commercial use throughout the barber industry is the attachment of a loop to the end of the hair clipper in proximity to where the electric cord extends from the hair clipper, referred to herein as the "bottom" of the hair clipper. A corresponding hook is attached to the edge or side wall of the counter adjacent the workspace of the barber and the hair clipper is hung in an "upside down" position along the side of the counter. Once the hair clipper is placed in a position wherein the hook extends through the loop, the hair clipper is relatively secured against inadvertent dropping. Losenno, U.S. Pat. No. 4,159,773, teaches this conventional solution in the field of beautician's tools such as hair dryers and curling irons.

An improvement that has recently been made in this "hanging" approach and which is believed to represent the state-of-the-art in hair clipper retention is disclosed in Smith, U.S. Pat. No. 5,379,903, wherein the electric cord of each hair clipper is retracted into a box against which the hair clippers hang bottom-up in an upside down position.

A disadvantage to the conventional solution, even when refined as disclosed in Smith, is that the electric cord of a hair clipper tends to extend below the hair clipper in the retained upside down position, which causes the electric cord to bend or curve a full one-hundred and eighty degrees after immediately extending from the hair clipper. This curvature places an extreme stress on the connection of the electric cord with the hair clipper and results in the electric cord malfunctioning, i.e., shorting out, before the full life expectancy of the hair clipper otherwise enjoyed is fully realized.

A second disadvantage to the conventional solution is that the electric hair clipper is only relatively secure when the hook is extended through the loop. Thus, if the hair clipper slides from the barber's grasp while attempting to place the loop over the hook, or if the barber prematurely releases the hair clipper believing that the loop and hook have registered, the hair clipper will once again be dropped and subject to breaking.

There thus continues a need in the barbering profession for an improved apparatus for receiving and retaining electric hair clippers which safeguards against the accidental dropping of the hair clippers but which does not reduce the useful life of the hair clippers by causing the electric cord to short out.

The present invention satisfies this need as well as provides other benefits and advantages which will become apparent to one of ordinary skill in the art based on the following disclosure.

SUMMARY OF THE PRESENT INVENTION

The present invention relates to a new and unobvious structure for receiving and retaining an electric hair clipper in a ready-to-use position for intermittent use by a barber during hair cutting.

The structure includes a base support member for supporting the bottom of the hair clipper and a back support member for supporting the upper back of the hair clipper. The back support member and base support member cooperate to retain the hair clipper in a ready-to-use disposition whereby a barber can easily yet securely grasp the hair clipper during hair cutting.

A connecting member extends between and connects together the base support member and the back support member. In particular, the connecting member intersects the base support member at a location spaced from opposite ends of the base support member, and the connecting member intersects the back support member at a location spaced from opposite ends of the back support member.

The structure further includes two side retaining members for preventing the top of the hair clipper from sliding out of the structure while in resting engagement with the back support member. In particular, each side retaining member extends from a respective end of the back support member in proximity to a respective left or right side of the hair clipper received in the structure.

Two base retaining members are further included for preventing the bottom of the hair clipper from sliding frontwardly out of the structure while in resting engagement with the base support member. Preferably, the base retaining members extend from respective opposite ends of the base support member in proximity to the lower front of the hair clipper.

In a feature of the present invention, the base support member includes two base support segments which diverge from the intersection of the connecting member to the base support member to thereby form a v-shaped or u-shaped slot. This slot permits the bottom of the hair clipper to be supported on the base support member with the electric cord thereof extending from the bottom of the hair clipper through the slot without engaging the support base member. Moreover, because the hair clipper is disposed in an upright position, the electric cord extends away from the hair clipper in a generally straight direction thereby avoiding the extreme bending of the cord at the hair clipper encountered in the prior art. This is true especially when the electric outlet into which the hair clipper is plugged is located below the top of a barber's counter.

In another feature of the present invention, the connecting member includes two straight connecting segments which intersect at first ends thereof at an angle to one another and which intersect at second ends thereof to the back support member and base support member respectively. The angle of intersection of the connecting segments provides a space located in the middle of and behind a retained hair clipper when supported by the back support member and base support member whereby a barber's fingers can slip behind and firmly grasp the hair clipper when withdrawing it from the structure.

In yet a further feature of the present invention, two generally straight connecting segments define a plane which divides the structure into a right side and a left side, the right side of the structure representing the mirror image of the left side of the structure about the plane.

In yet a further feature of the present invention, the intersection of two generally straight connecting segments define a mounting location where the structure can be mounted to a fixture. Moreover, the connecting segments preferably extend from the fixture to present the hair clipper in a reclined and ready-to-use disposition.

In yet another feature of the present invention, a plurality of hair clipper holding structures are provided for receiving and retaining a plurality of hair clippers. Moreover, each structure is designed to receive and retain a particular size hair clipper independent of the other structures whereby a plurality of various types and sizes of hair clippers can be stored in ready-to-use position at a barber's workspace. In yet a further feature, the plurality of structures are integrally joined by attachment to a mounting frame which mounts to the barber's counter and, preferably, an angle iron which attaches to the corner of the counter for presentation of each hair clipper at the counter's edge.

In the preferred embodiment, each retaining member and each support member are cylindrical and the structure is formed from bent rods welded together.

BRIEF DESCRIPTION OF THE DRAWINGS

These and other features of the present invention will become apparent to one of ordinary skill in the art with reference to the drawings and following detailed description of the preferred embodiment of the present invention, wherein.

DETAILED DESCRIPTION OF THE PREFERRED EMBODIMENT

Figures 1, 2:
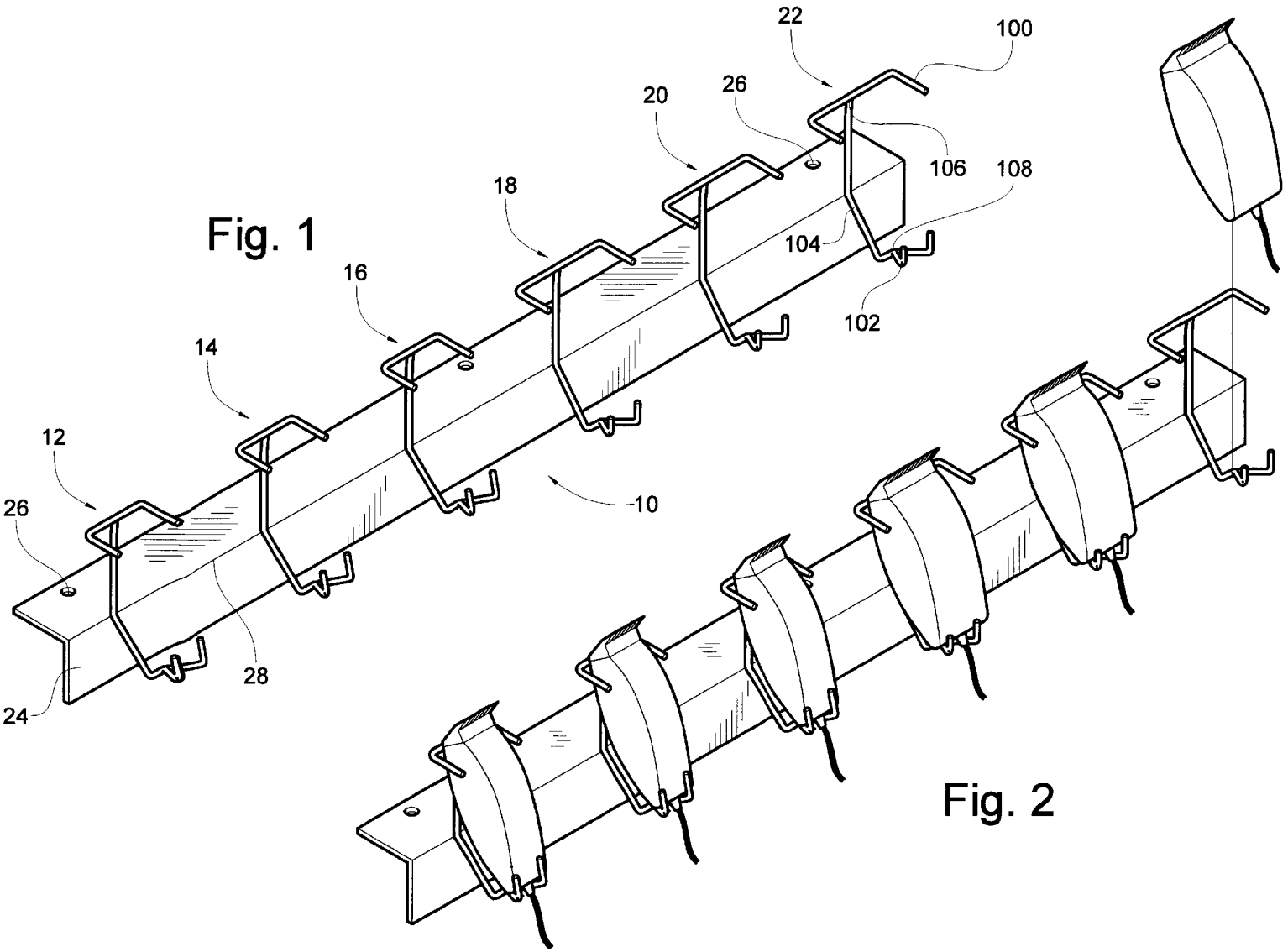
FIG. 1 is a perspective view of a preferred embodiment of a rack for receiving and retaining a plurality of electric hair clippers in accordance with the present invention.
FIG. 2 is a perspective view of the rack of FIG. 1 receiving and retaining a plurality of electric hair clippers.

Referring now to the figures, the preferred embodiment of a rack for receiving and retaining a plurality of electric hair clippers is shown in FIG. 1. The rack 10 includes six structures 12,14,16,18,20,22 each for receiving and retaining a single electric hair clipper. Each structure is attached in side-by-side disposition to a mounting frame 24 preferably comprising an elongate angle iron. The mounting frame 24 includes apertures 26 through which bolts or nails can be extended for mounting the mounting frame 24 to the edge of a barber's counter (not shown), but any other conventional mounting of the mounting frame 24 may be utilized in accordance with the present invention. Moreover, each structure is attached to the outside corner 28 of the angle iron whereby each structure will present an electric hair clipper retained therein in a ready-to-use disposition at the edge of the counter.

As shown in FIG. 2, each structure receives and retains an electric hair clipper. Furthermore, each structure is designed to receive and retain a predetermined size electric hair clipper. Thus, structures 12,14,16 in FIG. 2 receive and retain smaller electric clippers and structures 18,20,22 receive and retain larger electric clippers.

Figure 3:
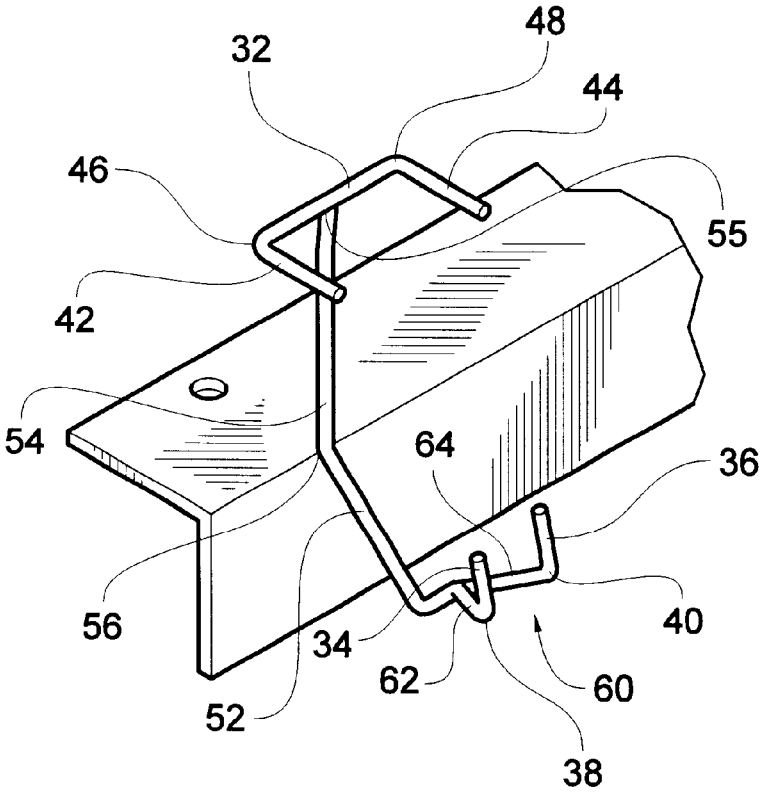
FIG. 3 is a perspective view of a preferred embodiment of a structure for receiving and retaining an electric hair clipper in accordance with the present invention.
Figure 5:
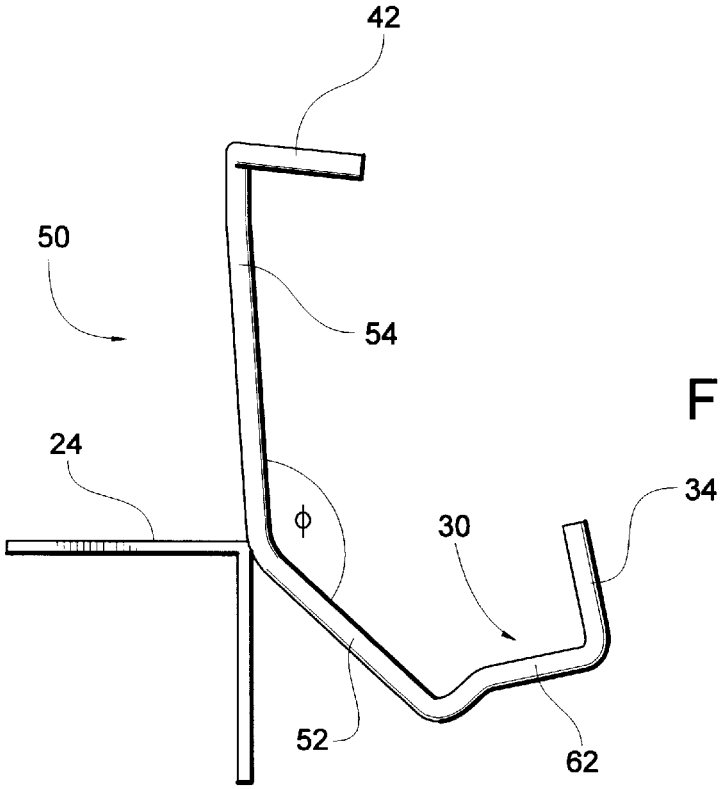
FIG. 5 is a side elevational view of the structure of FIG. 3.

Referring now to FIGS. 3 and 5, each preferred structure of the present invention includes a base support member 30 which serves to support the bottom of an electric hair clipper. The structure further includes a back support member 32 which serves to support an upper back portion of the hair clipper. As used herein, "back" refers to the side of the electric hair clipper which rests against the back support member and "front" refers to the side of the electric hair clipper located opposite the backside.

Together, the base support member 30 and back support member 32 cooperating to receive and retain the hair clipper in a ready-to-use position in the structure. Preferably, only the base support member 30 and back support member 32 support the electric hair clipper in resting engagement therewith.

Figure 6:
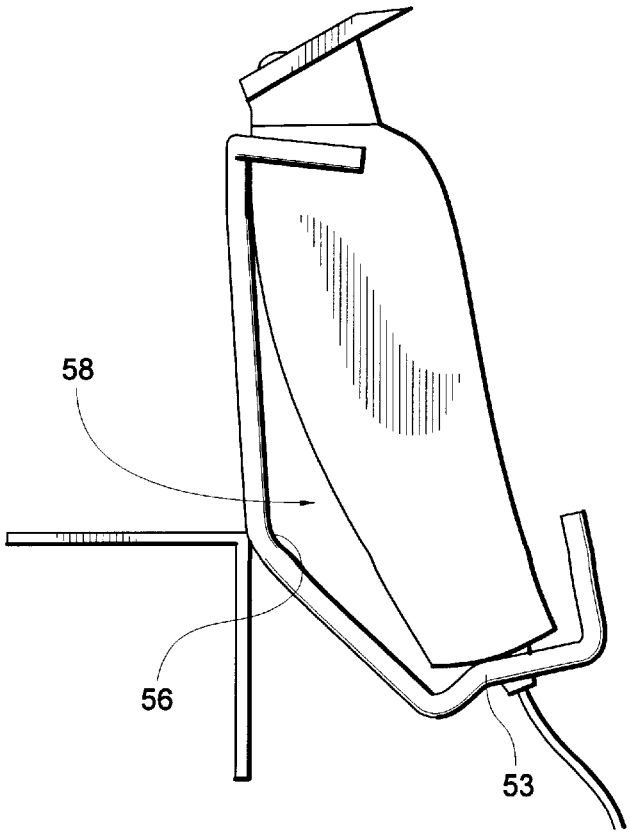
FIG. 6 is a side elevational view of the structure of FIG. 4.

To safeguard against the electric hair clipper accidentally dropping or falling from the holding structure, each structure includes a pair of base retaining members 34,36 which respectively extend from opposite ends 38,40 of the base support member 30. Furthermore, each base retaining member 34,36 preferably extends generally orthogonally to the base support member 30 and extends in proximity to a lower front side of the hair clipper as shown in FIG. 6. The base retaining members 34,36 thereby serve to prevent the bottom of the hair clipper from forwardly sliding out of the structure while in resting engagement with the base support member 30.

Figure 4:
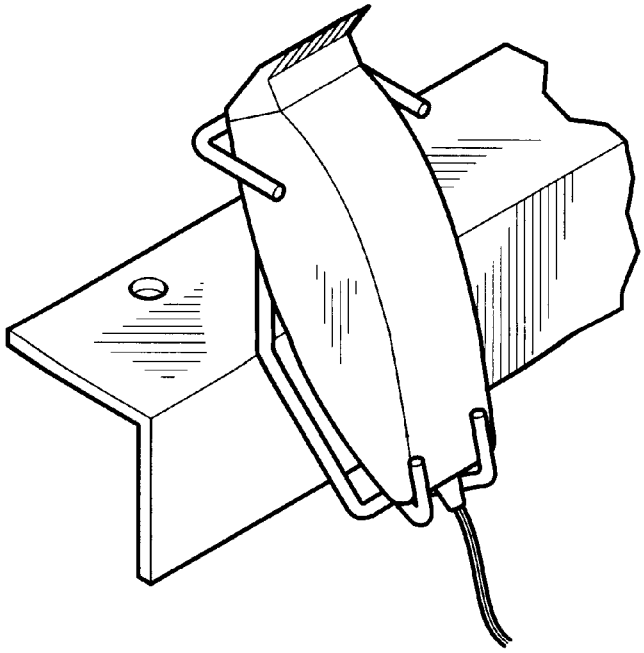
FIG. 4 is a perspective view of the structure of FIG. 3 retaining an electric hair clipper.

Similarly, two side retaining members 42,44 are included in the structure and extend from opposite ends 46,48 of the back support member 32. Furthermore, each side retaining member 42,44 preferably extends generally orthogonally to the back support member 32 and extends in proximity to the upper left and right sides of the electric hair clipper as shown in FIG. 4. The side retaining members 42,44 thereby serve to prevent the top of the hair clipper from sliding out of the structure while in resting engagement with the back support member 32.

Each structure also includes a connecting member 50 that extends between the base support member 30 and the back support member 32 to connect the two support members together. The connecting member 50 preferably includes two generally straight connecting segments 52,54 which intersect one another at first ends thereof to form a mounting location 56 of the structure to the mounting frame 24. Second ends 53,55 of the connecting segments 52,54 intersect the base support member 30 and back support member 32, respectively, to form an integral structure.

Connecting segments 52,54 preferably define a plane separating the structure into a right side and a left side with each side being a mirror image of the other about the plane.

Furthermore, connecting segments 52,54 preferably intersect one another at an angle $\phi$ whereby an electric hair clipper received in the structure is retained in an inclined disposition as shown, for example, in FIG. 6. Angle $\phi$ furthermore provides a space 58 behind an electric hair clipper retained in the structure whereby a barber's fingers may slip around the back of the hair clipper for a secure grip in withdrawing the hair clipper from the structure.

The electric cord of an electric hair clipper is accommodated in the present invention by the provision of a slot 60 in the base support member 30 of each structure. With reference now to FIGS. 3 and 4, the base support member 30 includes a pair of base support segments 62,64 which diverge from the intersection of the connecting segment 52 with the base support member 30. The divergence of the base support segments 62,64 serves to define a u-shaped or v-shaped slot 60 through which the electric cord of an electric hair clipper retained in the slot may extend without engaging the support base member 30 or any other part thereof.

In order to accommodate various sizes of electric hair clippers as shown in FIG. 2, the back support member 32 of each structure is formed with a length slightly greater than the side-to-side width perpendicular to the front to back direction of the electric hair clipper to be received and retained therein. Likewise, the base support member 30 is formed with base support segments 62,64 each having a length and intersecting at an angle sufficient to accommodate the reception of an electric cord therethrough while engaging and supporting the bottom of the hair clipper. Additionally, the connecting segments 52,54 are formed with sufficient lengths and intersect at a sufficient angle whereby the hair clipper is supported both at the bottom and top thereof.

Preferably the support members 30,32 and retaining members 34,36,42,44 each are comprise a cylindrical rod and, specifically, the back support member 32 and side retaining members 42,44 are formed from a bent cylindrical rod 100, the base support member 30 and base retaining members 34,36 are preferably formed from a bent cylindrical rod 102, and the connecting member is preferably formed from a bent cylindrical rod 104 with the three rods being welded together at weld points 106,108. However, each structure could otherwise be conventionally formed, such as by injection molding or other well known manufacturing method while coming within the contemplated scope of the present invention.

It will therefore be apparent from one having ordinary skill in the art that the rack of the present invention may accommodate a plurality of electric hair clippers in a ready-to-use position without the disadvantages encountered by the prior art structures and methods. A hair clipper is placed on the support base of the structure with the base retaining members first receiving the electric cord to guide the bottom of the hair clipper to the base support member. Then the hair clipper is laid back to rest against the back support member. Side retaining members prevent the hair clipper from being accidentally knocked out of the structure from the side and the base retaining members prevent the hair clipper from being pulled frontwardly out of the structure by the electric cord. Moreover, the electric cord extends generally straight from the hair clipper thereby avoiding the harsh bending of the cord found in the aforementioned prior art.

To further safeguard against inadvertent dropping, a spaced is provided behind a retained hair clipper by which a barber can firmly grasp the hair clipper when withdrawing it from the structure. Moreover, in replacing a withdrawn hair clipper, the electric cord is placed between the base retaining members to thereby guide the bottom of the hair clipper into the structure, thereby avoiding an accidental dropping of the hair clipper onto the floor resulting from misjudgment in determining whether a loop has registered with a hook.

It will therefore be readily understood by those persons skilled in the art that the present invention is susceptible of a broad utility and application. Many embodiments and adaptations of the present invention other than those herein described will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention, the present invention being limited only by the claims appended hereto and equivalents thereof.

What is claimed is:

1. An apparatus for a barbershop, comprising:

(a) an electric hair clipper; and (b) a structure supporting and retaining said electric hair clipper in a ready-to-use position for intermittent use by a barber during hair cutting, said structure including, (i) a base support member supporting a bottom of said electric hair clipper and a back support member supporting an upper back side of said electric hair clipper, said base support member and said back support member cooperating to fully support said electric hair clipper in a ready-to-use disposition, (ii) two base retaining members each respectively extending from opposite ends of said base support member generally orthogonal to said base support member and in proximity to a lower front side of said electric hair clipper, whereby said bottom of said electric hair clipper is prevented by said retaining members from sliding forwardly out of said structure while said electric hair clipper is supported by said base support member, (iii) two side retaining members each respectively extending from opposite ends of said back support member generally orthogonal to said back support member and in proximity to upper left and right sides of a top of said electric hair clipper, whereby said top of said electric hair clipper is prevented from sliding out of said structure while said electric hair clipper is supported by said back support member, and (iv) a connecting member extending between and connecting together said base support member and said back support member.

2. A barbershop apparatus according to claim 1 wherein said connecting member intersects said base support member at a location spaced from said opposite ends thereof and said connecting member intersects said back support member at a location spaced from said opposite ends thereof.

3. A barbershop apparatus according to claim 1 wherein said connecting member includes two generally straight connecting segments which intersect at respective first ends at an inclined angle to one another and which intersect at respective second ends to said back support member and to said base support member respectively, whereby said electric hair clipper is received and retained in a reclined position.

4. A barbershop apparatus according to claim 3 wherein said intersection of said connecting segments forms a mounting location whereat said structure is mounted to a fixture.

5. A barbershop apparatus according to claim 2 wherein said electric hair clipper includes an electric cord extending from said bottom thereof and said base support member includes two base support segments which diverge from said connection of said connecting member to said base support member, said base support segments supporting said bottom of said electric hair clipper and extending to form a v-shaped slot through which said electric cord. extends.

6. A barbershop apparatus according to claim 1 wherein said structure further includes a mounting frame, said mounting frame having two intersecting orthogonal mounting surfaces for mounting of said structure to an edge of a counter for presentation of said electric hair clipper at the counter's edge.

7. A barbershop apparatus according to claim 5 wherein said mounting frame includes an angle iron attached to said connecting member.

8. A structure for receiving and retaining an electric hair clipper in a ready-to-use position for intermittent use by a barber during hair cutting, comprising:

a base support member for supporting a bottom of an electric hair clipper and a back support member for supporting an upper back side of the electric hair clipper, said base support member and said back support member cooperating to fully support the electric hair clipper in a ready-to-use disposition;

two base retaining members each respectively extending from opposite ends of said base support member generally orthogonal to said base support member and in proximity to a lower front side of the electric hair clipper, whereby the bottom of the electric hair clipper is prevented by said retaining members from sliding forwardly out of the structure while the electric hair clipper is supported by said base support member;

two side retaining members each respectively extending from opposite ends of said back support member generally orthogonal to said back support member and in proximity to upper left and right sides of a top of the electric hair clipper, whereby the top of the electric hair clipper is prevented from sliding out of the structure while the electric hair clipper is supported by said back support member; and a connecting member extending between and connecting together said base support member and said back support member, said connecting member including two generally straight connecting segments which intersect at respective first ends at an inclined angle to one another and which intersect at respective second ends to said back support member and to said base support member respectively, whereby the electric hair clipper is received and retained in a reclined position.

9. A structure according to claim 8 wherein said connecting segments define a plane which divides the structure into a right side and a left side, said right side representing the mirror image of said left side about the plane.

10. A structure according to claim 8 wherein said intersection of said connecting segments forms a mounting location where the structure is mounted to a fixture.

11. A structure according to claim 10 further including a mounting base disposed at said intersection of said connecting segments, said mounting base having two intersecting orthogonal mounting surfaces for mounting of said structure to an edge of a counter.

12. An apparatus for a barbershop, comprising (a) a plurality of electric hair clippers;

(b) a mounting frame; and (c) a plurality of electric hair clipper holding structures attached to said mounting frame each for supporting and retaining a respective one of said plurality of said electric hair clippers in a ready-to-use position for intermittent use by a barber during hair cutting, each said structure including, (i) a base support member supporting a bottom of said electric hair clipper and a back support member supporting an upper back side of said electric hair clipper, said base support member and said back support member cooperating to fully support said electric hair clipper in a ready-to-use disposition, (ii) two base retaining members each respectively extending from opposite ends of said base support member generally orthogonal to said base support member and in proximity to a lower front side of said electric hair clipper, whereby said bottom of said electric hair clipper is prevented by said retaining members from sliding forwardly out of said structure while said electric hair clipper is supported by said base support member, (iii) two side retaining members each respectively extending from opposite ends of said back support member generally orthogonal to said back support member and in proximity to upper left and right sides of a top of sad electric hair clipper, whereby said top of said electric hair clipper is prevented from sliding out of said structure while said electric hair clipper is supported by said back support member, and (iv) a connecting member extending between and connecting together said base support member and said back support member.

13. An apparatus for a barbershop according to claim 12 wherein a said structure includes a said connecting member intersecting said base support member at a location spaced from said opposite ends thereof and said connecting member intersecting said back support member at a location spaced from said opposite ends thereof, and wherein said electric hair clipper includes an electric cord extending from said bottom thereof and said base support member includes two base support segments which diverge from said connection of said connecting member to said base support member, said base support segments supporting said bottom of said electric hair clipper and extending to form a v-shaped slot through which said electric cord extends.

14. A barbershop apparatus according to claim 12, wherein said plurality of electric hair clippers are of differing sizes.

15. An apparatus for a barbershop according to claim 12 wherein a said structure includes a said connecting member having two generally straight connecting segments which intersect at respective first ends at an inclined angle to one another and which intersect at respective second ends to said back support member and to said base support member respectively, whereby said electric hair clipper is received and retained in a reclined position.

16. An apparatus for a barbershop according to claim 15 wherein said intersection of said connecting segments forms a mounting location whereat said structure is mounted to a fixture.

17. An apparatus for a barbershop according to claim 16 wherein said structure further includes a mounting frame, said mounting frame having two intersecting orthogonal mounting surfaces for mounting of said structure to an edge of a counter for presentation of said electric hair clippers at the counter's edge.

18. A rack for receiving and retaining a plurality of electric hair clippers in a ready-to-use position for intermittent use by a barber during hair cutting, comprising (a) a plurality of electric hair clipper holding structures, each said structure including:

(i) a base support member for supporting a bottom of an electric hair clipper and a back support member for supporting an upper back side of the electric hair clipper, said base support member and said back support member cooperating to fully support the electric hair clipper in a ready-to-use disposition, (ii) two base retaining members each respectively extending from opposite ends of said base support member generally orthogonal to said base support member and adapted to be in proximity to a lower front side of the electric hair clipper, whereby the bottom of the electric hair clipper is prevented by said retaining members from sliding forwardly out of the structure while the electric hair clipper is supported by said base support member, (iii) two side retaining members each respectively extending from opposite ends of said back support member generally orthogonal to said back support member and adapted to be in proximity to upper left and right sides of a top of the electric hair clipper, whereby the top of the electric hair clipper is prevented from sliding out of the structure while the electric hair clipper is supported by said back support member, and (iv) a connecting member extending between and connecting together said base support member and said back support member; and (b) a mounting frame to which said structures are mounted, said mounting frame comprising two intersecting orthogonal mounting surfaces disposed in facing relation to one another at right-angles for attachment of the structure to an edge of a counter.

19. A rack according to claim 18 wherein said mounting frame is an angle iron.

20. A rack according to claim 18 wherein one of said plurality of electric hair clipper holding structures is larger than another one of said plurality of electric hair clipper holding structures for receiving a larger size electric hair clipper.

* * * * *